United States Patent [19]

Asano

[11] Patent Number: 4,495,903

[45] Date of Patent: Jan. 29, 1985

[54] INTERNAL COMBUSTION ENGINE

[75] Inventor: Akira Asano, Saitama, Japan

[73] Assignee: Honda Giken Kogyo Kabushiki Kaisha, Tokyo, Japan

[21] Appl. No.: 418,957

[22] Filed: Sep. 16, 1982

[30] Foreign Application Priority Data

Sep. 19, 1981 [JP] Japan ..... 56-148184

[51] Int. Cl.[3] ..... F01L 1/46

[52] U.S. Cl. ..... 123/90.38; 123/90.27; 123/195 C

[58] Field of Search ..... 123/90.38, 90.27, 195 C

[56] References Cited

U.S. PATENT DOCUMENTS 3,773,142 11/1973 Bragg et al. ..... 123/90.38 X 4,388,898 6/1983 Larson ..... 123/90.38

4,395,980 8/1983 Tominaga et al. ..... 123/90.27

FOREIGN PATENT DOCUMENTS 37507 3/1980 Japan ..... 123/90.27

*Primary Examiner*—William R. Cline

*Assistant Examiner*—Peggy A. Neils

*Attorney, Agent, or Firm*—Sughrue, Mion, Zinn, Macpeak & Seas

[57] ABSTRACT

Access to a valve actuating mechanism in a motorcycle having frame members closely spaced from the head cover is improved by constructing the head cover such that it is vertically divided into removably connected halves.

8 Claims, 5 Drawing Figures

INTERNAL COMBUSTION ENGINE

BACKGROUND OF THE INVENTION

The present invention relates to an internal combustion engine and, more particularly, to an overhead cam shaft type internal combustion engine in which a valve actuating mechanism is accommodated in a space defined by both a cylinder head and a head cover joined to the upper face of the cylinder head.

Where an internal combustion engine of the above-specified kind is constructed to have cylinders in a vertical or V-type configuration and is mounted on the body frame of a motorcycle, for example, just below the main tube of the frame thereof, the main tube comes close to the head cover of the cylinder head. If the height thereof is lowered to enable setting the height of the motorcycle at a low level, the gap between the main tube and the head cover is narrowed and this results in workability problems in attaching and detaching the head cover in the adjustment of a valve actuating mechanism, because the valve actuating mechanism protrudes from the upper face of the cylinder head.

SUMMARY OF THE INVENTION

The present invention has been developed in view of the background thus far described and has an object of providing an internal combustion engine of the aforementioned type, which facilitates the attaching and detaching of a head cover by constructing the head cover such that it can be vertically divided into two halves.

BRIEF DESCRIPTION OF THE DRAWINGS

The present invention will be described in the following in connection with one embodiment thereof with reference to the accompanying drawings; in which.

DETAILED DESCRIPTION OF THE PREFERRED EMBODIMENTS

Figure 1:
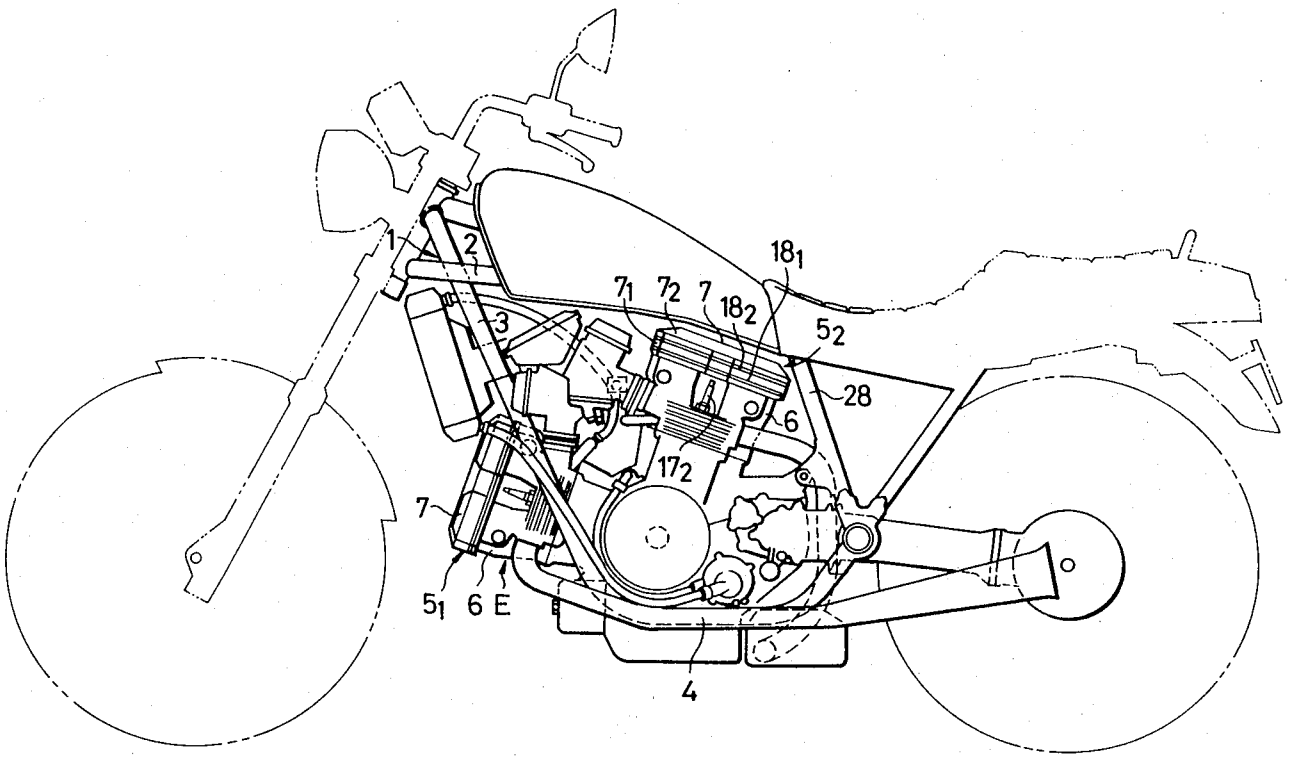
FIG. 1 is a side elevation showing a motorcycle.
Figure 2:
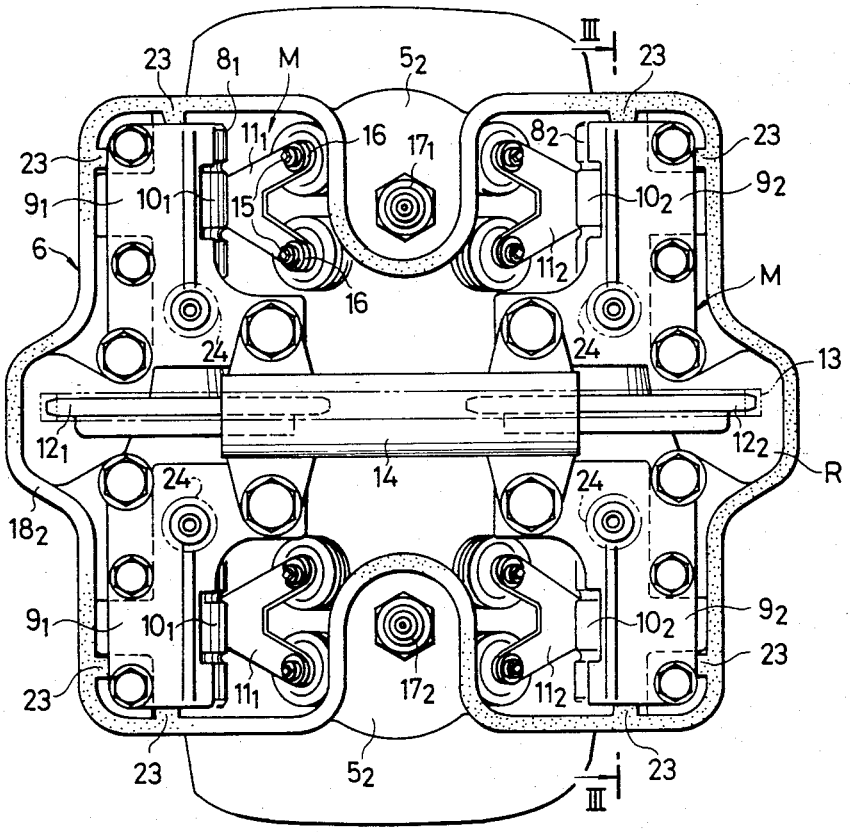
FIG. 2 is a top plan view showing a cylinder head thereof.
Figure 3:
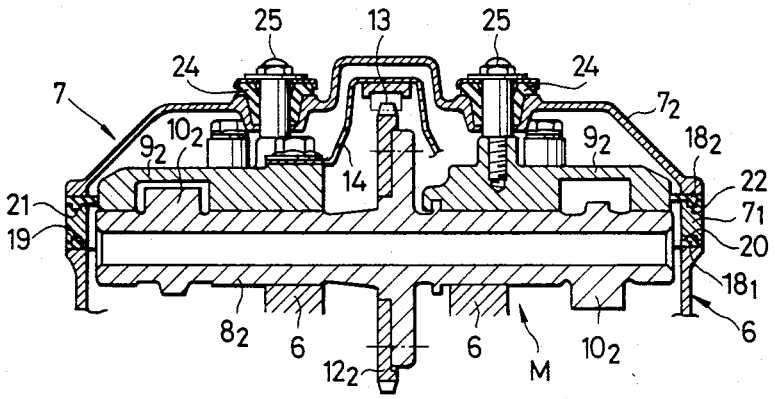
FIG. 3 is a section taken along the line III—III of FIG. 2 showing the state in which the head cover is joined to the cylinder head of FIG. 2.

Reference numeral 1 appearing in FIGS. 1 to 3 indicates the body frame of a motorcycle. A V-type internal combustion engine E is mounted on tube 3, a lower tube 4 and pillar tube 28 all below the main tube 2 of the body frame 1 such that its two first cylinders $\mathbf{5_1}$ are disposed at front positions whereas its two second cylinders $\mathbf{5_2}$ are disposed at rear positions. In both the second cylinders $\mathbf{5_2}$ at the rear positions, a valve actuating mechanism M is accommodated in a space R defined by a cylinder head 6 shared therebetween and by a head cover 7 joined to the upper face of the cylinder head 6.

The valve actuating mechanism is constructed to include an intake valve cam shaft $\mathbf{8_1}$ shared by the respective second cylinders $\mathbf{5_2}$ and an exhaust valve cam shaft $\mathbf{8_2}$; a pair of cam shaft holders $\mathbf{9_1}$ and $\mathbf{9_2}$ for rotatably holding the cam shafts $\mathbf{8_1}$ and $\mathbf{8_2}$ in cooperation with the cylinder head 6; respective pairs of rocker arms $\mathbf{11_1}$ and $\mathbf{11_2}$ adapted to be rocked by the paired cams $\mathbf{10_1}$ and $\mathbf{10_2}$ of the respective cam shafts $\mathbf{8_1}$ and $\mathbf{8_2}$; cam sprockets $\mathbf{12_1}$ and $\mathbf{12_2}$ secured to the middle portions of the respective cam shafts $\mathbf{8_1}$ and $\mathbf{8_2}$; a cam chain 13 made to run on the cam sprockets $\mathbf{12_1}$ and $\mathbf{12_2}$; and a cam chain cover 14 covering the cam chain 13. On the bifurcated leading end portions of each of the rocker arms $\mathbf{11_1}$ and $\mathbf{11_2}$, there are threaded valve clearance adjusting bolts 15 on which lock nuts 16 for fixing their positions are screwed. As a result, the paired intake or exhaust valves are opened by the single rocker arms $\mathbf{11_1}$ or $\mathbf{11_2}$. Reference numerals $\mathbf{17_1}$ and $\mathbf{17_2}$ indicate ignition plugs which are respectively attached to both the second cylinders $\mathbf{5_2}$.

The head cover 7 is constructed so as to be divided into two halves, i.e., an annular member $\mathbf{7_1}$, which is removably overlaid on the upper face of the cylinder head 6 through a first packing $\mathbf{18_1}$ made of rubber, and a shallow dish-shaped member $\mathbf{7_2}$ which is removably overlaid on the upper face of the annular member $\mathbf{7_1}$ through a second packing $\mathbf{18_2}$ made of rubber.

The first packing $\mathbf{18_1}$ is formed into a vertical section having an annular land 19 and is sandwiched between the cylinder head 6 and the annular member $\mathbf{7_1}$ such that its annular land 19 is fitted in an annular groove 20 formed in the lower face of the annular member $\mathbf{7_1}$. On the other hand, the second packing $\mathbf{18_2}$ is likewise formed into a sectional shape having an annular land 21 and is sandwiched between the annular member $\mathbf{7_1}$ and the dish-shaped member $\mathbf{7_2}$ such that its annular land 21 is fitted in an annular groove 22 which is formed in the upper face of the annular member $\mathbf{7_1}$. At the same time, the annular member $\mathbf{7_1}$ is positioned such that the respective pairs of positioning lands 23 formed to enclose the respective corners are so held in the vicinity of the four corners of the inner periphery of the second packing $\mathbf{18_2}$ as to abut against the outer sides of the respective cam shaft holders $\mathbf{9_1}$ and $\mathbf{9_2}$ acting as stationary members.

The dish-shaped member $\mathbf{7_2}$ is attached in a floating manner to the respective cam shaft holders $\mathbf{9_1}$ and $\mathbf{9_2}$ by inserting fastening bolts 25 into respective rubber mounts 24, which are disposed at four positions on the upper face of the dish-shaped member $\mathbf{7_2}$, and by fastening the bolts 25 in the respective cam shaft holders $\mathbf{9_1}$ and $\mathbf{9_2}$. Thus, the second packing $\mathbf{18_2}$ is prevented from shifting in the peripheral direction of the head cover 7 by the fitting relationships between the annular lands and grooves with the annular member $\mathbf{7_1}$. Moreover, the annular member $\mathbf{7_1}$ is fixed under pressure to the cylinder head 6 through the dish-shaped member $\mathbf{7_2}$, while being in a correctly positioned state, by having the respective positioning projections 23 of the second packing $\mathbf{18_2}$ abutting against the respective cam shaft holders $\mathbf{9_1}$ and $\mathbf{9_2}$.

With the construction thus far described, when in the valve clearance adjusting operation of the valve actuating mechanism M, the respective fastening bolts 25 are loosened, and the shallow dish-shaped member $\mathbf{7_2}$ of the head cover 7 is first lifted in the narrow space between the top thereof and the main tube 2 and then is taken out sideways. Next, the annular member $\mathbf{7_1}$ is lifted up and removed sideways from the relatively wide space between the valve actuating mechanism M and the main tube 2 after the dish-shaped member $\mathbf{7_2}$ has been removed. When the head cover 7 is to be attached, it is sufficient to overlay the annular member $\mathbf{7_1}$ and the dish-shaped member $\mathbf{7_2}$ in this order upon the upper side of the cylinder head 6. As a result, even if the gap between the main tube 2 and the head cover 7 is narrow or if the valve actuating mechanism M protrudes from the upper face of the cylinder head 6, the attaching and detaching operations of the head cover 7 can be performed with remarkable ease so that the height of the motorcycle can be set at a low level.

Figure 4:
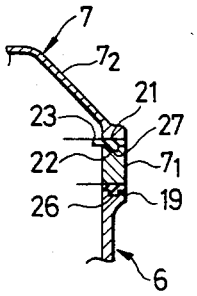
FIGS. 4 and 5 are sectional views showing portions of modified examples of the joining construction of the cylinder head and the head cover, respectively.
Figure 5:
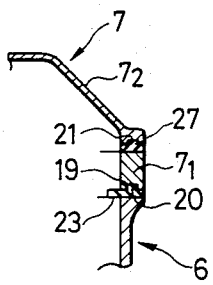

FIGS. 4 and 5 show modifications of the joining structure of the cylinder head 6 and the head cover 7. In the example of FIG. 4, the upper faces of the cylinder head 6 and the annular member $7_1$ are respectively formed with annular grooves 26 and 22 in which the lands 19 and 21 of the first and second packings $18_1$ and $18_2$ are respectively fitted. In this modification, the second packing $18_2$ is formed with respective positioning projections 23 made similar to the aforementioned ones. In another example in FIG. 5, the lower faces of the annular member $7_1$ and the dish-shaped member $7_2$ are respectively formed with annular grooves 20 and 27 in which the lands 19 and 21 of the first and second packings $18_1$ and $18_2$ are respectively fitted. In this modification, the first packing $18_1$ is formed with respective positioning projections 23 made similar to the aforementioned ones.

Incidentally, a valve actuating mechanism M similar to the aforementioned one is also accommodated in the space formed in the cylinder head 6 and the head cover 7 of the two first cylinders $5_1$ located toward the front, and the head cover 7 thereof may be constructed, if necessary, so that it can be divided into two halves similarly to the foregoing construction.

As has been described hereinabove, according to the present invention, in an internal combustion engine of the type in which the valve actuating mechanism is accommodated in such a space defined by both a cylinder head and a head cover joined to the upper face of the cylinder head, the head cover includes an annular member, which is removably overlaid on the upper face of the cylinder head, and a dish-shaped member, which is removably overlaid on the upper face of the annular member. Thus, the head cover can be vertically divided into the two halves. As a result, even if the head cover and a further member are closely spaced to each other or if the valve actuating mechanism protrudes from the upper face of the cylinder head, the dish-shaped member and the annular member both belonging to the head cover can be detached from within the narrow space by removing the former and then the latter, and both members can be attached in the reverse order. Thus, the attaching and detaching operations of the head cover can be conducted with ease.

What is claimed is:

1. An over head cam internal combustion engine for mounting adjacent a frame member, comprising a valve actuating mechanism having a camshaft accommodated in a space defined by both a cylinder head and a head cover joined to the upper face of said cylinder head, said head cover including an annular member removably overlaid on the upper face of said cylinder head, and a dish-shaped member removably overlaid on said upper face of said annular member, wherein the distance to said cylinder head from the boundary surface between said dish-shaped member and said annular member is greater than the distance to said cylinder head from said camshaft and wherein the boundary surface between said annular member and said cylinder head is located substantially level with the longitudinal axis of said camshaft wherein said distances are such that said head cover can be removed through a clearance between said valve mechanism and said frame which is smaller than the collective height of said head cover.

2. An apparatus as claimed in claim 1, further including a first packing between said upper face of said cylinder head and said annular member, and a second packing between said annular member and said dish-shaped member.

3. An apparatus as claimed in claim 2, said first packing including an annular land, and an annular groove formed in a lower face of said annular member for receiving said annular land.

4. An apparatus as claimed in claims 2 or 3, said second packing including an annular land, and an annular groove formed in an upper face of said annular member for receiving said annular land.

5. An apparatus as claimed in claim 1, wherein said engine is a V-type engine having at least two cylinders angularly displaced in relation to each other thereby forming a V, said V-type engine being mounted on a motorcycle frame with the central axis of each cylinder being included in the longitudinal center plane of the motorcycle and with the rear cylinder of said at least two cylinders and said head cover covering at least said rear cylinder located below a main tube comprising said motorcycle frame, said apparatus further comprising a first packing between said upper face of said cylinder head and said annular member, a second packing between said annular member and said dish-shaped member, and tightening bolts extending from said dish-shaped member to said cylinder head for clamping said annular member between said dish-shaped member and said cylinder head.

6. An apparatus as claimed in claim 5, said first packing including an annular land, and an annular groove formed in a lower face of said annular member for receiving said annular land.

7. An apparatus as claimed in claim 5, said second packing including an annular land, and an annular groove formed in an upper face of said annular member for receiving said annular land.

8. An apparatus as claimed in claim 6, said second packing including an annular land, and an annular groove formed in an upper face of said annular member for receiving said annular land.

* * * * *